United States Patent [19]

Martinmaas

[11] Patent Number: 4,752,262

[45] Date of Patent: Jun. 21, 1988

[54] LATERALLY UNSTABLE SMALL WATER CRAFT WITH STABILIZING WINGS

[76] Inventor: Werner W. Martinmaas, P.O. Box 6321, Reno, Nev. 89503

[21] Appl. No.: 34,213

[22] Filed: Apr. 3, 1987

[51] Int. Cl.[4] ..... A63C 15/00

[52] U.S. Cl. ..... 441/79; 114/126

[58] Field of Search ..... 441/74, 79; 114/122, 114/123, 126, 273, 39.2, 284

[56] References Cited

U.S. PATENT DOCUMENTS 3,090,978 5/1963 Hanson ..... 441/79

3,093,105 6/1963 Rebikoff ..... 114/126

FOREIGN PATENT DOCUMENTS 7811316 5/1979 Netherlands ..... 441/74

*Primary Examiner*—Joseph F. Peters, Jr.

*Assistant Examiner*—Jesûs D. Sotelo

*Attorney, Agent, or Firm*—Wood, Dalton, Phillips, Mason & Rowe

[57] ABSTRACT

A laterally unstable small water craft such as a sailboard, a kayak, a canoe, a sailfish, a sunfish, or the like is provided with laterally extending narrow stabilizing wings of relatively shallow vertical dimension that limit tilting of the craft. Preferably the wings are provided with mounts that permit independent adjustment of the wing rake angle, dihedral angle and angle of attack, and the wings may be folded to positions entirely between the longitudinal sides of the craft. Conveniently the wings and their mounts are provided as a kit for attachment to any particular type of small water craft.

16 Claims, 2 Drawing Sheets

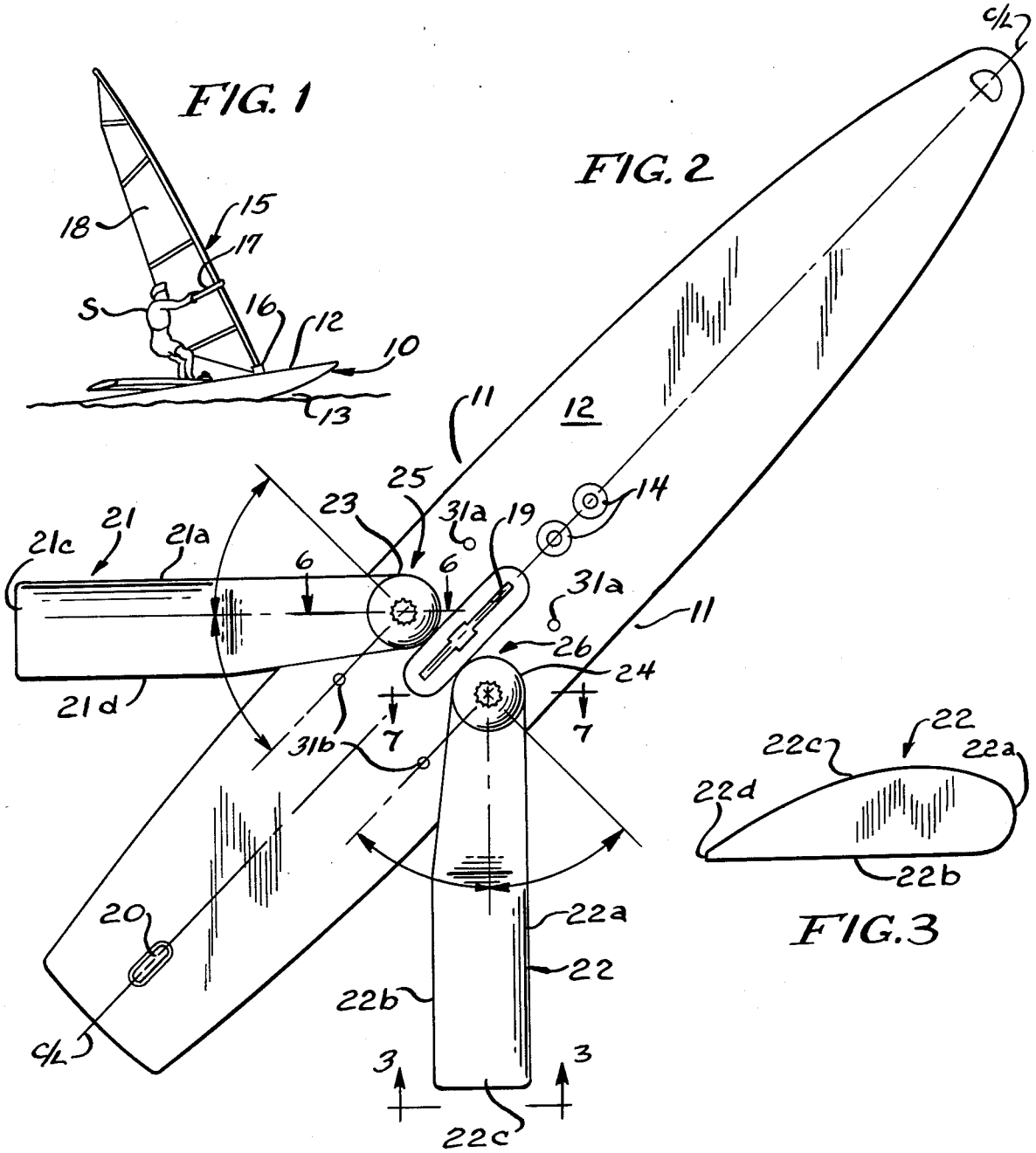
FIG. 3
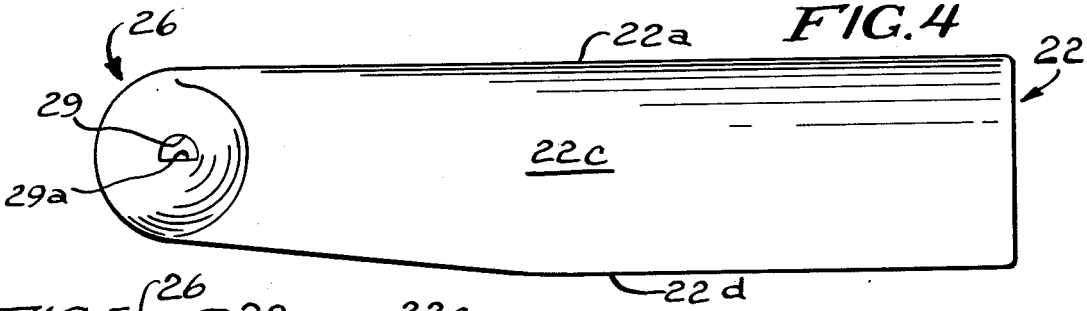
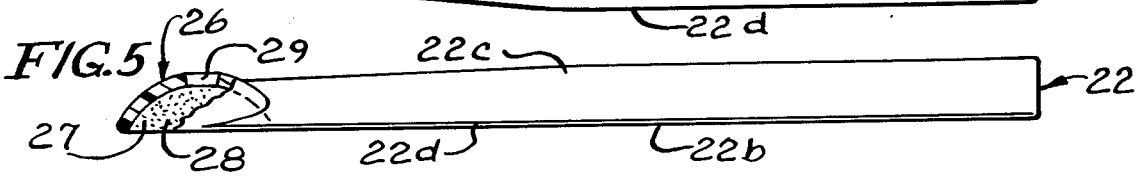

LATERALLY UNSTABLE SMALL WATER CRAFT WITH STABILIZING WINGS

This invention relates to laterally unstable small water craft such as sail boards, kayaks, canoes, sailfish, sunfish and the like which are provided with stabilizing wings that limit tilting of the craft. Conveniently the wings and their mounts are provided as a kit for attachment to any particular type of small water craft.

BACKGROUND OF THE INVENTION

There are several small water craft, generally for sports purposes, that are so laterally unstable that considerable skill is required to handle them. Probably the outstanding example is the sail board, which is extremely popular but which requires great skill to handle, and which can be used only be relatively young, strong and agile people.

The present invention is illustrated as applied to a sail board, but it is apparent from the principals of the invention that it may also be used with other laterally unstable small water craft to give them a lateral stability that makes them practical sports craft for many people who are not unable to use them safely, or at all.

Anybody who has watched a person try to maneuver a board sailer for the first time, or who has tried it himself, knows how difficult it is. It is not at all unusual for a novice to require an hour or more of steady effort before he albe to sail as much as 100 feet without capsizing.

Stabilizing devices for small water craft have, heretofore, generally consisted of outriggers provided with sponsons that interfere with normal use of the craft and that are entirely unsuitable for board sailers which travel at high speed and which, when handled by an expert, may sail clear of the water for many feet.

The present invention does not interfere in any way with all normal uses of a board sailer, and in fact may actually increase the speed at which they may be operated and the distances that they can "fly" out of the water.

SUMMARY OF THE INVENTION

The present invention relates to a laterally unstable small water craft, such as a board sailer, that is provided with a pair of relatively narrow stabilizing wings of relatively shallow vertical dimension that are secured to the craft in transversely aligned areas equidistant from the longitudinal center line so as to extend laterally from opposite longitudinal sides of the craft and limit tilting thereof.

In a most preferred embodiment of the invention means are provided for mounting each wing for adjustment of its rake angle, its dihedral angle, and its angle of attack.

Conveniently the wings and their mounts are provided as a kit for attachment of the wings to any particular type of small water craft.

THE DRAWINGS

FIG. 1 is a perspective view of a board sailer in use, that is provided with the stabilizing wings of the present invention;

FIG. 2 is a plan view of a sail board provided with the stabilizing wings of the invention;

FIG. 3 is an end elevational view of a wing on an enlarged scale, taken substantially as indicated along the line 3—3 of FIG. 2;

FIG. 4 is a plan view of a wing on a scale reduced from that of FIG. 3;

FIG. 5 is a side elevational view of a wing, partly in cross section, viewing FIG. 3 from the left;

DETAILED DESCRIPTION OF THE PREFERRED EMBODIMENT OF THE INVENTION

Figure 6:
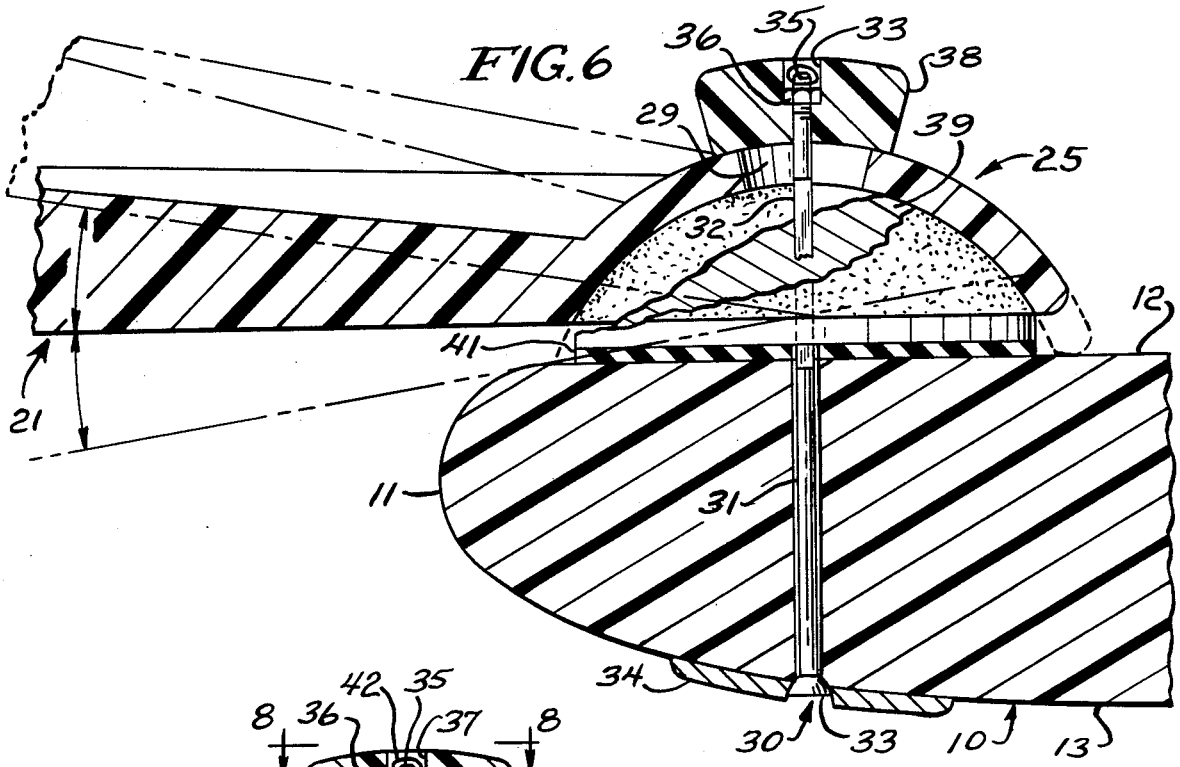
FIG. 6 is a fragmentary sectional view on an enlarged scale taken substantially as indicated along the line 6—6 of FIG. 2.

Referring to the drawings in detail, and referring first to FIGS. 1 and 2, a sail board, indicated generally at 10, has longitudinal sides 11, a longitudinal center line c/1, a normally above water deck surface 12, and a normally below water bottom surface 13. A pair of longitudinally spaced sockets 14 provide alternative mountings for a sail means 15 at the lower end of which is a rubber fitting 16 so that the sail hangs nearly parallel to the deck 12 except when it is held upright by a sailer S who grasps a bowed handlebar 17 that is a part of the frame for a sail 18. The sail board also includes a longitudinal slotted mounting 19 for a dagger board (not shown) and an aft slotted mounting 20 for a fin (not shown). The description to this point is that of any of several commercially available board sailers.

In order to give some idea of the dimensions of the various parts, the plan view of FIG. 2 was made from a sail board that is 12 feet long and about 2 feet wide at the widest point.

In accordance with the present invention, a port wing, indicated generally at 21, and a starboard wing, indicated generally at 22, are secured to the board 10 in transversely aligned areas 23 and 24 that are equidistant from the longitudinal center line c/1 so that the wings extend laterally from opposite longitudinal sides 11 of the board and limit tilting thereof. The wings 21 and 22 are, of course, left and right handed, but are otherwise identical. As best seen in FIG. 3, the wing 22 has an arcuate leading surface **22*a*, a planar under surface 22*b*, and an arcuate top surface 2*c* that tapers to a narrow trailing margin 22*d*; and corresponding parts of the wing 21** are indicated by corresponding reference characters to those in FIG. 3.

The wings 21 and 22 have respective mounting end portions, indicated generally at 25 and 26, and details of the mounting end portion 26 are illustrated in FIGS. 4 and 5. As shown in those figs., both the top surface **22*c* and the trailing margin 22*d* of the wing 22 taper toward the wing mounting portion 26, and the mounting portion 26 has a recess providing a shallow socket 27 that has a stippled surface 28. An opening 29 in the top of the socket 27 is semicircular, with a flat side 29*a*** the purpose of which will be described hereinafter.

Figure 7:
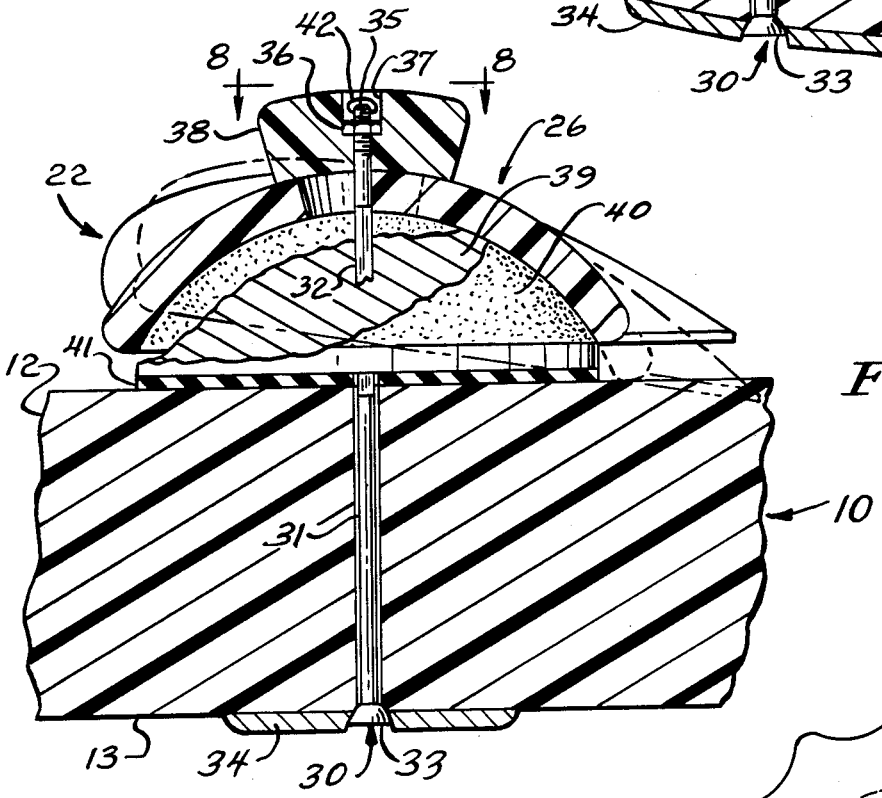
FIG. 7 is a view like FIG. 6 taken substantially along the line 7—7 of FIG. 2.

As best seen in FIGS. 6 and 7, a pair of mounting pins 30 extend through bores 31 in the board 10 and have upper portions 32 that extend upwardly from the plane of the deck surface 12. Each of the pins 30 has a head 33 that seats in a large, thin washer 34 on the bottom surface 13 of the board, and the pins are rotatable in the bores 31.

The upper end portions 32 of the pins 30 are square, and the pins have upper extremities 35 that are cylindrical and threaded to receive hexagonal clamping nuts 36 that fit snugly in complementary bores 37 in the tops of fluted handles 38 that permit ready manual rotation of the nuts 36 which serve as clamping nuts for the wings 21 and 22.

Fixed upon the square upper portion 32 of the mounting pins 30 are shallow dome members 39 that have stippled outer surfaces 40 complementary to the shallow stippled sockets 27.

Friction pads 41 surround the pins 30 between the deck surface 12 and the domes 39.

As indicated by the arcuate arrows in FIG. 2, the wings 21 and 22 may be pivoted about the pins 30 relative to the board 10 so that they are adjustable generally parallel to the plane of the deck 12 to any location between a position normal to the longitudinal center line c/1 of the board and positions folded between the longitudinal sides 11. during such adjustment, the pins 30 rotate in the bores 31, while the domes 39 and the wings 21 and 22 turn with the pins. The stippled surfaces 28 and 40 of the socket and dome cause them to remain interlocked at the same time the domes and wings may rotate upon the friction pads 41 which effectively prevent unintended pivotal movement of each wing while permitting the wings to be manually rotated to adjust their rake angles as seen in FIG. 2.

FIG. 6 illustrates by dot-dash lines the way in which the dihedral angle of each of the wings 21 and 22 may be adjusted relative to the board 10; while FIG. 7 illustrates by broken lines how the angle of attack of each wing 21 and 22 may be adjusted. The openings 29 in the tops of the sockets 27 permit the necessary tilting movement of the wings relative to the domes, and the planar sides 29*a* of the openings 29 prevent the angle of attack from being inadvertently adjusted in the wrong direction. As indicated in FIG. 6, the wings 21 and 22 may have either a negative or a positive dihedral angle.

As seen in FIG. 2, the board 10 may be provided with bores 31*a* and 31*b* that are fore and aft of the bores 31 so the wings may be mounted in different positions along the length of the board.

Figure 8:
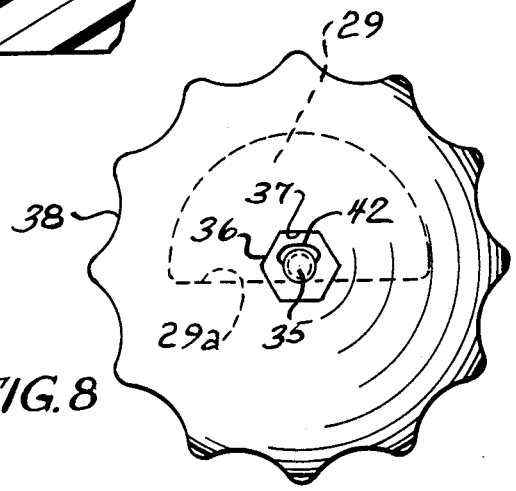
FIG. 8 is a plan view of a clamping nut and handle taken substantially as indicated along the line 8—8 of FIG. 7.

As seen in FIGS. 6–8, the threaded upper extremities of the pins 30 may be laterally bored to receive locking loops 42 that prevent the clamping nuts 36 and handles 38 from being accidentally disconnected from the pins 30.

It is apparent from the foregoing description that the wings and their mounts may be sold as a kit for attachment to any particular type or size of laterally unstable small water craft. In the case of a board sailer, such a kit consists of wings 21 and 22, pins 30, washers 34, domes 39, nuts 37 and handles 38, friction pads 41, and locking loops 42.

It is apparent that a stabilizing kit for types of water craft other than board sailers would require mounts different from those here disclosed; but it is thought that only mechanical skill would be required to provide the necessary mounts for fastening the wings to a kayak, a canoe, a sail fish, or any similar laterally unstable small water craft.

Thus, for example, in the case of a canoe a pair of brackets would need to be clamped to a thwart, and the pins would be mounted upon the brackets. Correspondingly, for a kayak the pins would be suitably mounted upon a frame member.

For a board sailer, an alternative mounting for the pins 30 could consist of a clamping strap that entirely encircles the board so as to eliminate the need for forming bores in the board.

A board sailer that is to be made originally for use with stabilizing wings might be formed with recesses along the longitudinal marginal portions of the deck 12 so that the wing mounts and wings are recessed in the board.

A prototype of the present apparatus, tested upon a 12 foot board sailer, has wings that are 11 inches from the arcuate leading surface to the narrow trailing margin, 44 inches from the wing pivot axis 30 to the wing tip, and approximately 3 inches thick maximum.

The prototype was just tested by the inventor, a 60 year old man with no prior board sailing experience. In his first trail run he sailed about a half mile from shore, came about, and returned to the shore from which he had started, and he neither capsized nor lost control of the craft at any time. Any novice board sailor or anybody who has seen a novice board sailer starting to learn, knows that this is completely impossible without the wings of the present invention.

The foregoing detailed description is given for clearness of understanding only and no unnecessary limitations should be understood therefrom, as modifications will be obvious to those skilled in the art.

I claim:

1. In a laterally unstable small water craft that has a normally above water deck surface, a normally below water bottom surface, a longitudinal center line, and longitudinal sides, the improvement comprising:

a pair of relatively narrow stabilizing wings of relatively shallow vertical dimension;

a mounting means securing each wing to the craft in transversely aligned areas equidistant from the longitudinal center line so as to extend laterally from opposite longitudinal sides of the craft and limit tilting thereof, each said mounting means providing pivotal adjustment of each wing generally parallel to the plane of the deck to any location between a position normal to the longitudinal center line of the craft and a position folded against the longitudinal sides of the craft;

means operatively associated with each said mounting means for adjusting the dihedral angle of the wing; and means for effectively preventing unintended pivotal movement of each wing.

2. The improvement of claim 1 in which the means mounting each wing on the craft includes means for adjusting the angle of attack of the wing.

3. The improvement of claim 1 in which each wing has an arcuate leading surface and tapers to a narrow trailing margin.

4. A stabilizing kit for a laterally unstable small water craft that has a normally above water deck surface, a normally below water bottom surface, a longitudinal center line, and longitudinal sides, said kit comprising, in combination:

a pair of mounting pins that are adapted to be mounted on the craft in transversely aligned positions equidistant from the longitudinal center line and near the longitudinal sides of the craft, said pins having upper portions that are adapted to extend upwardly from the plane of the deck surface;

and a pair of relatively narrow stabilizing wings of relatively shallow vertical dimension that may be fixed to said upper portions of the pins so as to extend laterally from said longitudinal sides of the craft to limit tilting thereof, each of said pins providing a pivot axis about which a wing is pivotally adjustable generally parallel to the plane of the deck to any location between a position normal to the longitudinal center line of the craft and a position folded against the longitudinal sides of the craft, a thread on an upper extremity of each pin;

and a clamping nut that is threaded to engage said thread to releasably secure a wing member on the pin.

5. The kit of claim 4 which includes a shallow dome through which each pivot pin extends, a shallow socket in the underside of the wing that is complementary to said dome, an opening in the upper portion of the wing surrounding the pivot pin to permit the wing to swing on said dome to adjust both the dihedral angle and the angle of attack of the wing, and the clamping nut firmly fixes the wing onto the dome.

6. The kit of claim 5 in which the dome and the socket have releasably interengaging surfaces.

7. The kit of claim 4 which includes a friction pad that surrounds the pin beneath the wing to prevent unintended pivotal movement of the wing about its pivot axis while allowing manual pivoting of the wing without loosening the clamping nut.

8. The kit of claim 4 in which each wing has an arcuate leading surface and tapers to a narrow trailing margin.

9. The kit of claim 4 in which the pins are adapted to extend through bores in the craft.

10. In a laterally unstable small water craft that has a normally above water deck surface, a normally below water bottom surface, a longitudinal center line, and longitudinal sides, the improvement comprising:

a pair of relatively narrow stabilizing wings of relatively shallow vertical dimension;

a mounting means securing each wing to the craft in transversely aligned areas equidistant from the longitudinal center line so as to extend laterally from opposite longitudinal sides of the craft and limit tilting thereof, each said mounting means comprising a pivot about which the wing is rotatable generally parallel to the plane of the deck to adjust the rake of the wing;

and a modified ball and socket joint surrounding said pivot for independently adjusting the dihedral angle of the wing and the angle of attack of the wing.

11. The improvement of claim 10 in which the wing is rotatable about the pivot between a position normal to the longitudinal center line of the craft and a position folded against the longitudinal sides of the craft.

12. The improvement of claim 10 in which the wings have inner end portions with undersides resting upon the deck, and upper portions.

13. The improvement of claim 12 in which each pivot comprises a pin extending upwardly from the deck near the longitudinal sides of the craft, each wing is rotatable about an axis provided by one of said pins for adjustment generally parallel to the plane of the deck to any location between a position normal to the longitudinal center line of the craft and a position between the longitudinal sides of the craft, each pivot pin has a threaded upper end portion, a clamping nut engages said threaded upper end portion, and friction means surrounds each pivot pin between the underside of the wing and the deck to effectively prevent unintended pivotal movement of the wing while allowing manual pivoting of the wing without loosening the clamping nut.

14. The improvement of claim 13 which includes a shallow dome through which each pivot pin extends, a shallow socket in the underside of the wing that is complementary to said dome, an opening in the upper portion of the wing surrounding the pivot pin to permit the wing to swing on said dome to adjust both the dihedral angle and the angle of attack of the wing, and the clamping nut firmly fixes the wing onto the dome.

15. The improvement of claim 14 in which the dome and the socket have releasably interengaging surfaces.

16. In a laterally unstable small water craft that has a normally above water deck surface, a normally below water bottom surface, a longitudinal center line, and longitudinal sides, the improvement comprising:

a pair of relatively narrow stabilizing wings of relatively shallow vertical dimension;

and means for detachably mounting each wing on the craft at any of a plurality of positions along the length of the craft, said wings in each of said positions being transversely aligned with one another and equidistant from the longitudinal center line so as to extend laterally from opposite longitudinal sides of the raft and limit tilting thereof.

* * * * *